US009730473B2

(12) United States Patent
Shinkawa et al.

(10) Patent No.: US 9,730,473 B2
(45) Date of Patent: Aug. 15, 2017

(54) NON-BURNING TYPE FLAVOR INHALER AND CAPSULE UNIT

(71) Applicant: JAPAN TOBACCO INC., Tokyo (JP)

(72) Inventors: Takeshi Shinkawa, Tokyo (JP); Hirofumi Matsumoto, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 15/084,220

(22) Filed: Mar. 29, 2016

(65) Prior Publication Data

US 2016/0206004 A1 Jul. 21, 2016

Related U.S. Application Data

(63) Continuation of application No. PCT/JP2014/075537, filed on Sep. 25, 2014.

(30) Foreign Application Priority Data

Sep. 30, 2013 (JP) ..... 2013-204177

(51) Int. Cl.
*F22B 29/06* (2006.01)
*A24F 47/00* (2006.01)
(Continued)

(52) U.S. Cl.
CPC ..... *A24F 47/008* (2013.01); *B65D 85/70* (2013.01); *H05B 3/0014* (2013.01)

(58) Field of Classification Search
None
See application file for complete search history.

(56) References Cited

U.S. PATENT DOCUMENTS 2,860,638 A * 11/1958 Bartolomeo ..... A24F 47/002 128/202.21
4,171,000 A * 10/1979 Uhle ..... A61M 15/06 131/273
(Continued)

FOREIGN PATENT DOCUMENTS

EP 0 845 220 A1 6/1998
IE S20070633 A2 9/2008
(Continued)

OTHER PUBLICATIONS

International Search Report, issued in PCT/JP2014/075537, dated Jan. 6, 2015.
(Continued)

*Primary Examiner* — Thor Campbell
(74) *Attorney, Agent, or Firm* — Birch, Stewart, Kolasch & Birch, LLP

(57) ABSTRACT

A non-burning type flavor inhaler includes a main body unit having the non-inhalation end; and a capsule unit configured to be attachable/detachable to/from the main body unit. The main body unit includes an aerosol source, an atomizer, and a power source. The capsule unit includes a solid flavor source, and a filter adjacent to the inhalation end side with respect to the flavor source. A part of an outer surface of the flavor source except a portion adjacent to the filter is covered with a predetermined film composed of an impermeable member. The main body unit is provided with a breaker for breaking the part of the predetermined film in a part adjacent to the capsule unit.

16 Claims, 3 Drawing Sheets

(51) Int. Cl.
*B65D 85/00* (2006.01)
*H05B 3/00* (2006.01)

(56) References Cited

U.S. PATENT DOCUMENTS

| | | | | |
|---|---|---|---|---|
| 5,095,921 | A | 3/1992 | Losee et al. | |
| 5,144,962 | A * | 9/1992 | Counts | A24F 47/008 128/200.14 |
| 5,249,586 | A | 10/1993 | Morgan et al. | |
| 5,479,948 | A | 1/1996 | Counts et al. | |
| 5,535,735 | A * | 7/1996 | McPherson | A24F 47/002 128/202.21 |
| 7,726,320 | B2 * | 6/2010 | Robinson | A24F 47/008 131/194 |
| 8,156,944 | B2 * | 4/2012 | Han | A24F 47/008 128/202.21 |
| 8,899,238 | B2 * | 12/2014 | Robinson | A24F 47/008 131/194 |
| 8,955,522 | B1 * | 2/2015 | Bowen | A24F 47/008 128/202.21 |
| 9,277,770 | B2 * | 3/2016 | DePiano | A24F 47/008 |
| 9,326,547 | B2 * | 5/2016 | Tucker | H01C 17/00 |
| 2007/0095357 | A1 | 5/2007 | Besso et al. | |
| 2007/0267031 | A1 * | 11/2007 | Hon | A24F 47/008 131/273 |
| 2008/0092912 | A1 | 4/2008 | Robinson et al. | |
| 2009/0126745 | A1 * | 5/2009 | Hon | A24F 47/008 131/273 |
| 2010/0006113 | A1 * | 1/2010 | Urtsev | A24F 47/008 131/273 |
| 2010/0242974 | A1 * | 9/2010 | Pan | A24F 47/008 131/273 |
| 2011/0005535 | A1 * | 1/2011 | Xiu | A24F 47/008 131/273 |
| 2011/0236002 | A1 * | 9/2011 | Oglesby | A61M 15/06 392/386 |
| 2012/0285446 | A1 | 11/2012 | Van Der Mark | |
| 2014/0261495 | A1 * | 9/2014 | Novak, III | A24F 47/008 131/329 |
| 2015/0027459 | A1 * | 1/2015 | Collett | H05B 3/265 131/328 |
| 2015/0040929 | A1 * | 2/2015 | Hon | A24F 47/008 131/329 |
| 2015/0164141 | A1 * | 6/2015 | Newton | H01M 2/1055 131/329 |
| 2015/0335071 | A1 * | 11/2015 | Brinkley | F22B 1/284 131/328 |
| 2015/0342256 | A1 * | 12/2015 | Chen | H05B 3/06 392/404 |
| 2015/0342257 | A1 * | 12/2015 | Chen | H05B 3/06 392/390 |
| 2015/0342258 | A1 * | 12/2015 | Chen | H05B 3/06 131/329 |
| 2016/0000147 | A1 * | 1/2016 | Li | A24F 47/008 131/329 |

FOREIGN PATENT DOCUMENTS

| | | | |
|---|---|---|---|
| JP | 7-147965 | A | 6/1995 |
| JP | 3996188 | B2 | 10/2007 |
| JP | 2010-506594 | A | 3/2010 |
| JP | 2010-104310 | A | 5/2010 |
| JP | 2013-516266 | A | 5/2013 |
| WO | WO 96/32854 | A2 | 10/1996 |
| WO | WO 97/48293 | A1 | 12/1997 |

OTHER PUBLICATIONS

Canadian Intellectual Property Office, "Office Action," issued in connection with Canadian Patent Application No. 2,925,645, dated Feb. 20, 2017.

Extended European Search Report, dated May 19, 2017, for European Application No. 14849646.6.

* cited by examiner

NON-BURNING TYPE FLAVOR INHALER AND CAPSULE UNIT

CROSS REFERENCE TO RELATED APPLICATIONS

This application is a Continuation of PCT International Application No. PCT/JP2014/075537, filed on Sep. 25, 2014, which claims priority under 35 U.S.C. 119(a) to Patent Application No. 2013-204177, filed in the Japan on Sep. 30, 2013, all of which are hereby expressly incorporated by reference into the present application.

TECHNICAL FIELD

The present invention relates to a non-burning type flavor inhaler having a shape extending from a non-inhalation end toward an inhalation end along a predetermined direction, and relates to a capsule unit to be used in a non-burning type flavor inhaler.

BACKGROUND ART

A non-burning type flavor inhaler for inhaling flavor without burning has been known. The non-burning type flavor inhaler has a shape extending from a non-inhalation end toward an inhalation end along a predetermined direction. The non-burning type flavor inhaler comprises an aerosol source for generating an aerosol, a heat source for heating the aerosol source without burning, and a power source for supplying power to the heat source (for example, Patent Literature 1).

CITATION LIST

Patent Literature

Patent Literature 1: Japanese PCT National Publication No. 2010-506594

SUMMARY OF THE INVENTION

A first feature is summarized as a non-burning type flavor inhaler having a shape extending from a non-inhalation end toward an inhalation end along a predetermined direction, comprising: a main body unit having the non-inhalation end; and a capsule unit configured to be attachable/detachable to/from the main body unit, wherein the main body unit includes an aerosol source that generates an aerosol, an atomizer that atomizes the aerosol source without burning, and a power source that supplies power to the atomizer, the capsule unit includes a solid flavor source provided on the inhalation end side than the aerosol source, and a filter adjacent to the inhalation end side with respect to the flavor source, a part of an outer surface of the flavor source except a portion adjacent to the filter is covered with a predetermined film composed of an impermeable member, and the main body unit is provided with a breaker for breaking the part of the predetermined film in a part adjacent to the capsule unit.

A second feature according to the first feature is summarized as that the predetermined film includes at least one compound chosen from a group consisting of gelatin, polypropylene, polyethylene and polyethylene-terephthalate.

A third feature according to any one of the first and second features is summarized as that an airflow resistance of the filter is 5 mmAq or more and 20 mmAq or less.

A fourth feature according to any one of the first to third features is summarized as that an airflow resistance of the capsule unit is 10 mmAq or more and 100 mmAq when the part of the predetermined film is broken by the breaker.

A fifth feature according to any one of the first to fourth features is summarized as that a film thickness of the predetermined film is 0.1 μM or more and 0.3 μm or less.

A sixth feature according to any one of the first to fifth features is summarized as that a volume of a space defined by the filter and the predetermined film is 0.6 ml or more and 1.5 ml or less.

A seventh feature according to any one of the first to sixth features is summarized as that the atomizer is a heat source that heats the aerosol source without burning.

An eighth feature is summarized as a capsule unit in a non-burning type flavor inhaler having a shape extending from a non-inhalation end toward an inhalation end along a predetermined direction, which is configured to be attachable/detachable to/from a main body unit that has the non-inhalation end and includes an aerosol source that generates an aerosol, an atomizer that heats the aerosol source without burning, and a power source that supplies power to the atomizer, the capsule unit comprising: a solid flavor source; and a filter adjacent to the inhalation end side with respect to the flavor source, wherein a part of an outer surface of the flavor source except a portion adjacent to the filter is covered with a predetermined film composed of an impermeable member.

DESCRIPTION OF EMBODIMENTS

Figure 1:
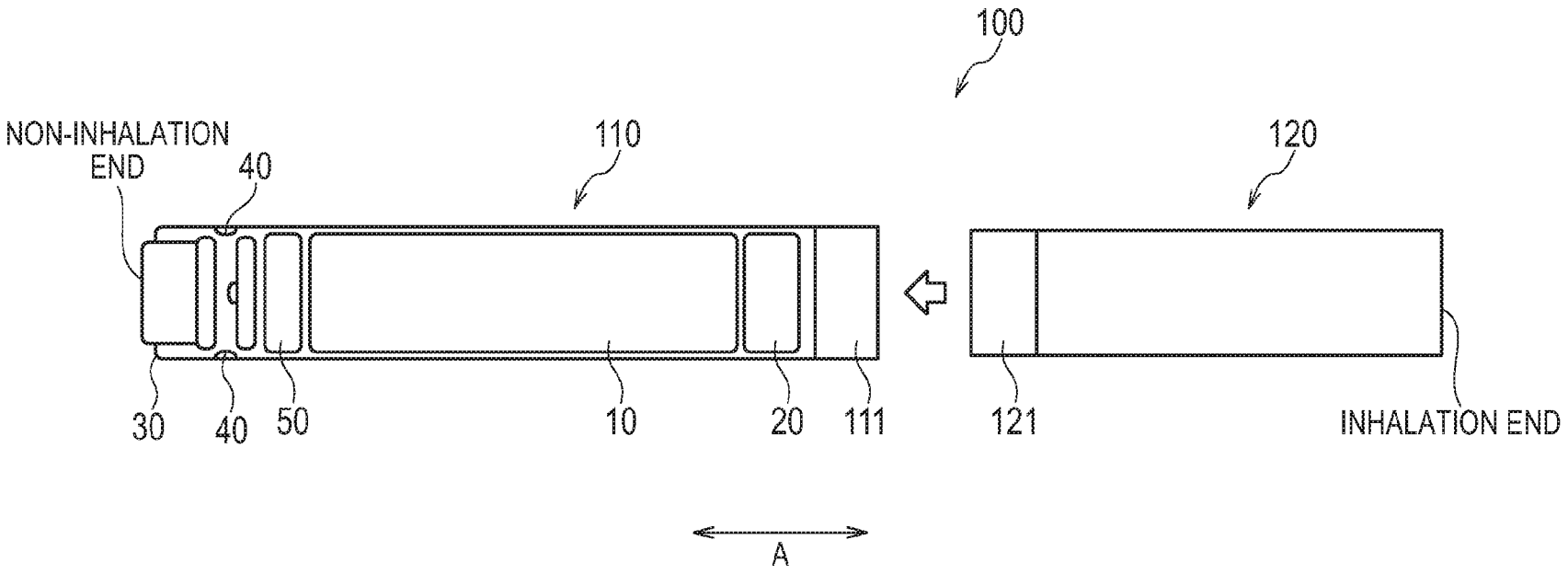
FIG. 1 is a diagram showing a non-burning type flavor inhaler 100 according to a first embodiment.

Hereinafter, embodiments of the present invention will be described. In the following description of the drawings, the same or similar parts are denoted by the same or similar reference numerals. It should be noted that the drawings are schematic, and the ratios of dimensions and the like are different from the actual ones.

Therefore, specific dimensions and the like should be determined by referring to the following description. Of course, the drawings include the parts having different dimensions and ratios.

OVERVIEW OF EMBODIMENTS

As a configuration of the non-burning type flavor inhaler, the non-burning type flavor inhaler including a flavor source (e.g., a tobacco source) provided on an inhalation end side than an aerosol source and a filter provided on an inhalation end side than a flavor source, is considerable.

The prevent inventors have examined the non-burning type flavor inhaler having the above-described configuration, and acquired the knowledge that a service life of an aerosol source is longer than that of a flavor source in such a non-burning type flavor inhaler. Therefore, in such a non-burning type flavor inhaler, although a service life of an aerosol source is not expired, a service life of a flavor source is supposed to be expired. Assuming such a case, when an aerosol source and a flavor source are integrally formed in a non-burning type flavor inhaler, an aerosol source must be discarded with a flavor source when a service life of a flavor source is expired.

On the hand, the present inventors have found that a service life of a filter is much closer to a service life of a flavor source than an aerosol source in a non-burning type flavor inhaler.

Further, since a flavor source is degraded by touching air, it is preferable to keep a flavor source in a state not touching air as much as possible until using a non-burning type flavor inhaler.

A non-burning type flavor inhaler according to an embodiment has a shape extending from a non-inhalation end toward an inhalation end along a predetermined direction. The non-burning type flavor inhaler comprises a main body unit having the non-inhalation end and a capsule unit configured to be attachable/detachable to/from the main body unit. The main body unit includes an aerosol source that generates an aerosol, an atomizer that atomizes the aerosol source without burning, and a power source that supplies power to the atomizer. The capsule unit includes a solid flavor source provided on the inhalation end side than the aerosol source, and a filter adjacent to the inhalation end side with respect to the flavor source. A part of an outer surface of the flavor source except a portion adjacent to the filter is covered with a predetermined film composed of an impermeable member. The main body unit is provided with a breaker for breaking the part of the predetermined film in a part adjacent to the capsule unit.

First, in the embodiment, a capsule unit including a filter and a flavor source is configured to be attachable/detachable to/from a main body unit including an aerosol source, based on the knowledge that a service life of the filter is much closer to a service life of the flavor source than the aerosol source. In other words, the capsule unit is provided to be separated from the aerosol source. This prevents wasting of the articles composing the non-burning type flavor inhaler.

Second, in the embodiment, a part of the outer surface of a flavor source except a portion adjacent to a filter is covered with a predetermined film composed of an impermeable member. This suppresses convection of outside air and air within a space partitioned by the filter and the predetermined film. On the other hand, since the air inlet hole, the aerosol source, the flavor source and the inhalation end are initially communicated pneumatically by breaking a part of a predetermined film by a breaker when using a non-burning type flavor inhaler, the flavor source can be kept in a fresh state until using a non-burning type flavor inhaler.

First Embodiment

Non-Burning Type Flavor Inhaler

Figure 2:
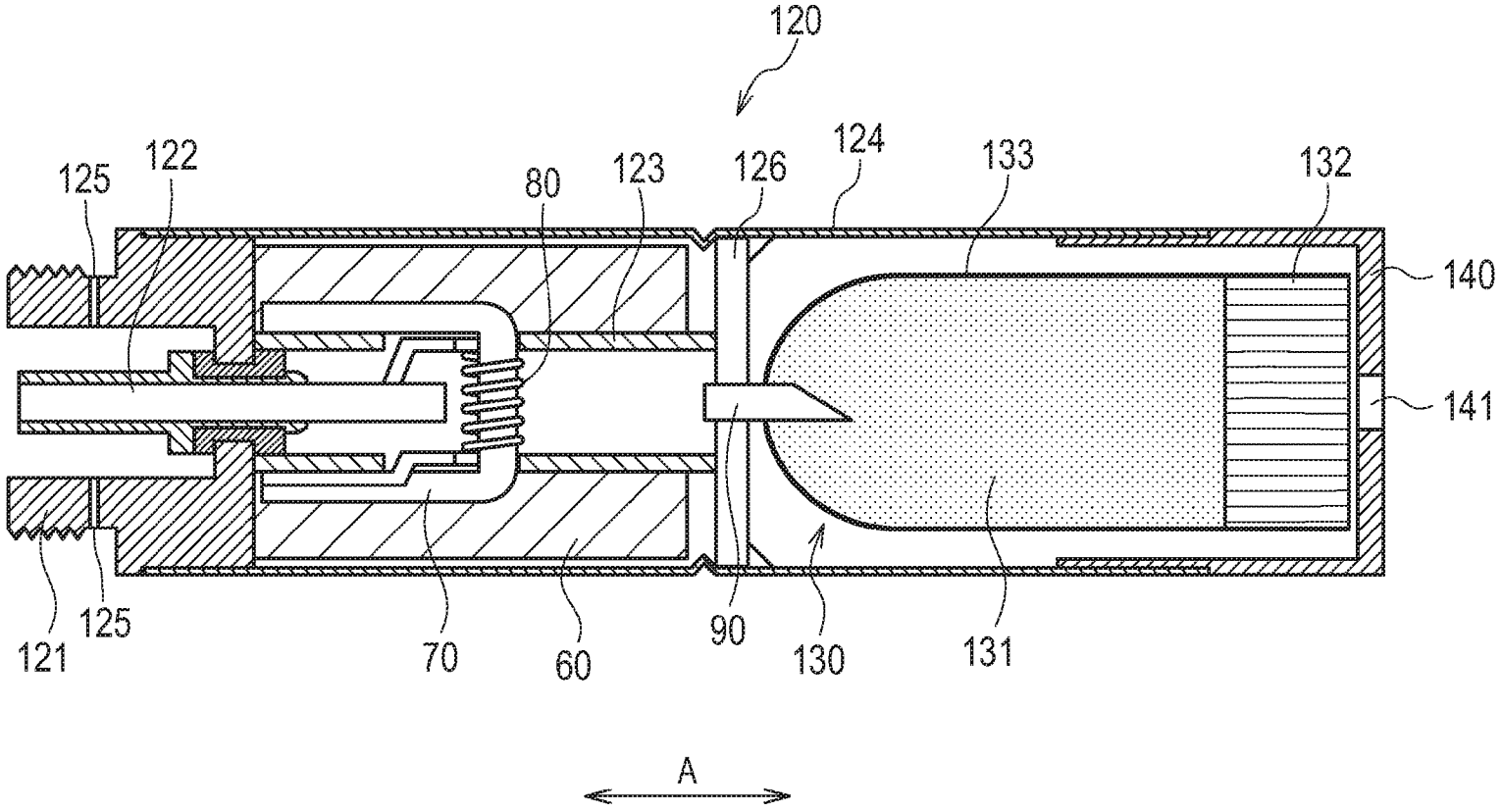
FIG. 2 is a diagram showing an atomizing unit 120 according to a first embodiment.

Hereinafter, a non-burning type flavor inhaler according to a first embodiment will be explained. FIG. 1 is a diagram showing a non-burning type flavor inhaler 100 according to a first embodiment. FIG. 2 is a diagram showing an atomizing unit 120 according to a first embodiment.

In the first embodiment, the non-burning type flavor inhaler 100 is a device for inhaling flavor without burning, and has a shape extending along a predetermined direction A that is a direction from a non-inhalation end toward an inhalation end.

As showed in FIG. 1, the non-burning type flavor inhaler 100 comprises an electrical unit 110 and an atomizing unit 120. The electrical unit 110 has a female connector 111 in a part adjacent to the atomizing unit 120. The atomizing unit 120 has a male connector 121 in a part adjacent to the electrical unit 110. The female connector 111 has a spiral groove extending along a direction orthogonal to the predetermined direction A. The male connector 121 has a spiral projection extending along a direction orthogonal to the predetermined direction A. By screwing the male connector 121 into the female connector 111, the atomizing unit 120 and the electrical unit 110 are connected each other. The atomizing unit 120 is configured to be attachable/detachable to/from the electrical unit 110.

The electrical unit 110 comprises a power source 10, a sensor 20, a pushbutton 30, a light-emitting element 40 and a control circuit 50.

The power source 10 is a lithium-ion battery, for example. The power source 10 supplies power required for operating the non-burning type flavor inhaler 100. For example, the power source 10 supplies power to the sensor 20, the light-emitting element 40 and the control circuit 50. Further, the power source 10 applies power to a heat source 80 described later.

The sensor 20 detects a wind pressure generated by a user's inhaling action. Specifically, the sensor 20 detects a negative pressure when the air is inhaled toward the atomizing unit 120. The sensor 20 is not particularly limited, but may be composed of a piezoelectric element.

The pushbutton 30 is configured to be pressed into the inhalation end side along the predetermined direction A. For example, by a predetermined action of the pushbutton 30 (i.e. an action for continuously pressing the pushbutton 30 over a predetermined number of times), the power of the non-burning type flavor inhaler 100 is turned on. When the power of the non-burning type flavor inhaler 100 is turned on, power is supplied to the control circuit 50 from the power source 10 and power is supplied to the sensor 20 and light-emitting element 40 from the power source 10 via the control circuit 50. Note that the power supply to the heater 80 is performed when the power is turned on and also the user's inhaling action is detected by the sensor 20. That is, the power supply to the heater 80 is not performed in a non-inhalation state that the aerosol is not inhaled.

Moreover, by a predetermined action of the pushbutton 30 (i.e. an action for long press of the pushbutton 30), the power of the non-burning type flavor inhaler 100 may be turned off. Since the power of the non-burning type flavor inhaler 100 is turned off by the predetermined action of the pushbutton 30, consumption power can be decreased when the non-burning type flavor inhaler 100 is not used.

The push button 30 may be a configuration for performing at least one of turning on or turning off the power of the non-burning type flavor inhaler 100.

The light-emitting element 40 is a light source such as an LED and an electric lamp. The light-emitting element 40 is provided on a sidewall extending along a predetermined direction. The light-emitting element 40 is preferably provided in the vicinity of the non-inhalation end. Thus, compared with a case where a light-emitting element is provided in the vicinity of the non-inhalation end on an axial line in the predetermined direction A, a user can easily recognize a light-emitting pattern of the light-emitting element 40 during an inhalation action. A light-emitting pattern of the light-emitting element 40 is a pattern to notify a user of a state of the non-burning type flavor inhaler 100.

The control circuit 50 controls the operation of the non-burning type flavor inhaler 100. In particular, the control circuit 50 controls a light-emitting pattern of the light-emitting element 40, and controls power supplied to a heat source 80.

The atomizing unit 120 comprises, as showed in FIG. 2, a holder 60, an absorber 70, a heat source 80 and a breaker 90. The atomizing unit 120 comprises a capsule unit 130 and an inhalation unit 140. The atomizing unit 120 has an air inlet hole 125 for taking outside air inside, an airflow path 122 that communicates with the electrical unit 110 (sensor 20) via the male connector 121, and a ceramic 123 that is arranged in a cylindrical shape. The atomizing unit 120 has a cylindrical outer wall 124 forming the outer shape of the atomizing unit 120. A space surrounded by the ceramic 123 forms an airflow path. The ceramic 123 contains alumina, for example, as a main component.

The holder 60 has a cylindrical shape, and holds the aerosol source for generating aerosol. The aerosol source is liquid such as propylene glycol and glycerin. The holder 60 is composed of a porous body impregnated with an aerosol source, for example. The porous body is a resin web, for example.

Further, in the first embodiment, the ceramic 123 is arranged inside the holder 60, suppressing volatilization of the aerosol source held by the holder 60.

The absorber 70 is provided adjacent to the holder 60, and is composed of a substance to absorb the aerosol source from the holder 60. The absorber 70 is made of glass fiber, for example.

The heat source 80 heats the aerosol source without burning. For example, the heat source 80 is a heating wire wound around the absorber 70. The heat source 80 heats the aerosol source absorbed by the absorber 70.

The breaker 90 is a member for breaking a part of predetermined film 133 in the state that the capsule unit 130 is mounted. In the embodiment, the breaker 90 is held by a partition member 126 for partitioning the atomizing unit 120 and the capsule unit 130. The partition member 126 is made of Polyacetal resin. The breaker 90 is a hollow cylindrical needle extending along a predetermined direction A, for example. By piercing a tip of the hollow needle into a predetermined film 133, a part of the predetermined film 133 is broken. Further, an inner space of the hollow needle forms an airflow path that communicates pneumatically the atomizing unit 120 with the capsule unit 130. It is preferable that a mesh having a roughness of not passing a material composing the flavor source 131 is provided inside the hollow needle. The roughness of the mesh is 80 meshes or more and 200 meshes or less, for example.

In such a case, the insertion depth of the hollow needle into the capsule unit 130 is preferably 1.0 mm or more and 5.0 mm or less, more preferably, 2.0 mm or more and 3.0 mm or less. At this insertion depth, the parts except a desired portion are not broken, suppressing detachment of the flavor source 131 filled in the space which is partitioned by the predetermined film 133 and the filter 132. Furthermore, since the detachment of the hollow needle from the space is suppressed, a proper airflow path to the filter 132 from the hollow needle can be preferably maintained.

In a vertical section with respect to the predetermined direction A, a sectional area of a vertical needle is preferably 2.0 $mm^2$ or more and 3.0 $mm^2$ or less. Thus, the flavor source 131 is prevented from falling off the capsule unit 130 when the hollow needle is removed.

The tip of the hollow needle preferable has an inclination of 30° or more and 45° or less with respect to the vertical direction to the predetermined direction A.

However, the embodiment is not limited to this. The breaker 90 may be a part adjacent to the predetermined film 133 in a state that the capsule unit 130 is mounted. A part of the predetermined film 133 may be broken by a pressure applied to such a part by a user.

The capsule unit 130 is configured to be attachable/detachable to/from the main body unit. The capsule unit 130 comprises a flavor source 131, a filter 132, and a predetermined film 133. The flavor source 131 is filled in a space partitioned by the predetermined film 133 and the filter 132. The main body unit is a unit that is composed of parts other except the capsule unit 130. For example, the main body unit includes the electrical unit 110, the holder 60, the absorber 70 and the heat source 80.

The flavor source 131 is provided on the inhalation end side than the holder 60 holding the aerosol source, and generates flavor inhaled by a user together with aerosol generated by the aerosol source. It is noted that the flavor source 131 is composed of a solid substance so as not to flow out of the space partitioned by the predetermined film 133 and the filter 132. As a flavor source 131, it is possible to use shredded tobacco, a molded body of granulated tobacco material, and a molded body formed into a sheet tobacco material. The flavor source 131 may be composed of a plant other than tobacco (for example, mint, herbs, and the like). The flavor source 131 may be given flavors such as menthol.

When the flavor source 131 is composed of tobacco material, as the tobacco material is apart from the heat source 80, it is possible to inhale the flavor without heating the tobacco material. In other words, it is noted that inhalation of unwanted substance generated by heating the tobacco material is suppressed.

In the first embodiment, the amount of the flavor source 131 filled in the space partitioned by the filter 132 and the predetermined film 133 is preferably 0.15 g/cc or more and 1.00 g/cc or less. The volume occupancy of the flavor source 131 in the space partitioned by the filter 132 and the predetermined film 133 is preferably 50% or more and 100% or less. The volume of the space partitioned by the filter 132 and the predetermined film 133 is preferably 0.6 ml or more and 1.5 ml or less. In such conditions, the flavor source 131 can be contained to the extent enough to enable a user to taste flavor while maintaining an appropriate size of the capsule unit 130.

In the state where a part of the predetermined film 133 is broken by the breaker 90 and where the atomizing unit 120 communicates with the capsule unit 130, when air is inhaled from a tip portion (non-broken portion) of the capsule unit 130 to a distal end of the filter 132 at a flow rate of 1050 cc/min, an airflow resistance (pressure loss) of the capsule unit 130 is preferably 10 mmAq or more and 100 mmAq or less, as a whole, more preferably, 20 mmAq or more and 90 mmAq or less. By setting the airflow resistance of the flavor source 131 to the above preferable range, aerosol is prevented from being overly filtered by the flavor source 131, and thus flavor can be efficiently supplied to a user. Incidentally, 1 mmAq corresponds to 9.80665 Pa, and the airflow resistance can be expressed by Pa.

The filter 132 is adjacent to the inhalation end side with respect to the flavor source 131, and is composed of a permeable substance. The filter 132 is preferably an acetate filter, for example. The filter 132 preferably has roughness of a degree not to pass through a material constituting the flavor source 131.

An airflow resistance of the filter 132 is preferably 5 mmAq or more and 20 mmAq or less. Accordingly, it is possible to efficiently pass through aerosol while efficiently absorbing a vapor component generated by the flavor source 131, and thus proper flavor can be supplied to a user. Further, it is possible to give a user an appropriate feeling of air resistance.

A ratio (mass ratio) between the mass of the flavor source 131 and the mass of the filter 132 is preferably in a range of 3:1 to 20:1, more preferably, in a range of 4:1 to 6:1.

The predetermined film 133 is formed integrally with the filter 132, and is composed of impermeable material. The predetermined film 133 covers a part of the outer surface of the flavor source 131 except a portion adjacent to the filter 132. The predetermined film 133 includes at least one compound selected from a group consisting of gelatin, polypropylene and polyethylene terephthalate. Gelatin, polypropylene, polyethylene and polyethylene terephthalate are not permeable, and suitable for forming a thin film. Gelatin, polypropylene, polyethylene and polyethylene terephthalate provide a sufficient resistance to moisture contained in the flavor source 131. Polypropylene, polyethylene and polyethylene terephthalate are especially excellent in a water resistance. Further, gelatin, polypropylene and polyethylene have a base resistance, and are thus hardly degraded by a basic component, even when the flavor source 131 has a basic component.

A thickness of the predetermined film 133 is preferably 0.1 μm or more and 0.3 μm or less. Accordingly, it is possible to easily break a part of the predetermined film 133 while maintaining a function of protecting the flavor source 131 by the predetermined film 133.

As described above, although the predetermined film 133 is formed integrally with the filter 132, the predetermined film 133 is bonded to the filter 132 by paste or the like. Or, by setting the outer shape of the predetermined film 133 smaller than that of the filter 132 in the vertical direction with respect to the predetermined direction A, the filter 132 may be stuffed into the predetermined film 133 and may be fitted into the predetermined film 133 by an expansion force of the filter 132. Alternatively, the filter 132 may be provided with an engagement part for engaging the predetermined film 133.

A shape of the predetermined film 133 is not particularly limited, but preferably has a concave shape in the vertical cross-section with respect to the predetermined direction A. In such a case, after filling the flavor source 131 inside the predetermined film 133 having the concave shape, an opening of the predetermined film 133 filled with the flavor source 131 is closed by the filter 132.

When the predetermined film 133 has the concave shape in the vertical cross-section with respect to the predetermined direction A, a maximum sectional area (i.e., a sectional area of an opening in which the filter 132 is fitted) of the sectional area of the space surrounded by the predetermined film 133, is preferably 25 $mm^2$ or more and 80 $mm^2$ or less, more preferably, 25 $mm^2$ or more and 55 $mm^2$ or less. In such a case, in the vertical cross-section with respect to the predetermined direction A, a sectional area of the filter 132 is preferably 25 $mm^2$ or more and 55 $mm^2$ or less. A thickness of the filter 132 in the predetermined direction A is preferably 3.0 mm or more and 7.0 mm or less.

The inhalation unit 140 has an inhalation hole 141. The inhalation hole 141 is an opening to expose the filter 132. A user inhales flavor together with aerosol by inhaling aerosol through the inhalation hole 141.

In the first embodiment, the inhalation unit 140 is configured to be attachable/detachable to/from the outer wall 124 of the atomizing unit 120. For example, the inhalation unit 140 has a cup shape configured to be fitted to an inner surface of the outer wall 124. However, the embodiment is not limited to this. The inhalation unit 140 may be attached rotatably to the outer wall 124 with a hinge or the like.

In the first embodiment, the inhalation unit 140 is provided separately from the capsule unit 130. In other words, the inhalation unit 140 constitutes a part of the main body unit. However, the embodiment is not limited to this. The inhalation unit 140 may be provided integrally with the capsule unit 130. In such a case, it is noted that the inhalation unit 140 constitutes a part of the capsule unit 130.

(Function and Effect)

In the first embodiment, the capsule unit 130 including the filter 132 and the flavor source 131 is configured to be attachable/detachable to/from the main body unit including the aerosol source, based on the knowledge that the service life of the filter 132 is much closer to the service life of the flavor source 131 than that of the aerosol source held by the holder 60. In other words, the capsule unit 130 is provided separately from the holder 60 holding the aerosol source. Thus, the articles composing the non-burning type flavor inhaler 100 are not wasted.

In the first embodiment, a part of the outer surface of the flavor source 131 except the portion adjacent to the filter 132 is covered by the predetermined film 133 composed of an impermeable member. This suppresses convection of outside air and the air within the space partitioned by the filter 132 and the predetermined film 133. Since the air inlet hole 125, the aerosol source, the flavor source 131 and the inhalation end are initially communicated pneumatically by breaking a part of the predetermined film 133 by the breaker 90 when using the non-burning type flavor inhaler 100, the flavor source 133 can be kept in a fresh state until using the non-burning type flavor inhaler.

In the first embodiment, the predetermined film 133 contains at least one compound selected from a group consisting of gelatin, polypropylene, polyethylene, and polyethylene terephthalate. Thus, compared with the case constituting the predetermined film by HPMC (hydroxypropyl methylcellulose) or the like, absorption of the components such as nicotine contained in the flavor source 131 can be suppressed, a sufficient resistance to a solvent can be obtained, and a desired result can be realized at low cost.

[Modification 1]

Hereinafter, a modification 1 of the first embodiment will be described. Hereinafter, differences between the first embodiment and the modification 1 will be mainly described.

Figure 3A:
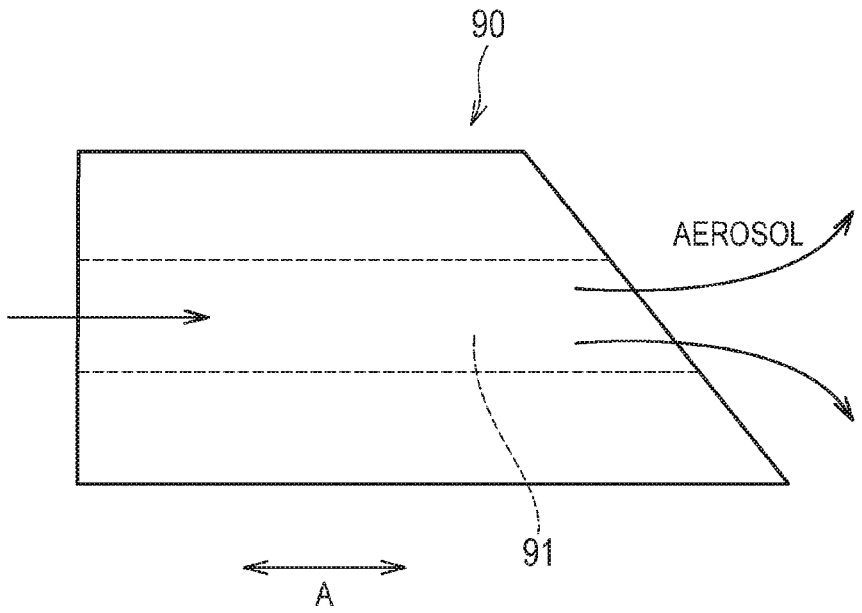
FIG. 3 (*a*) is a diagram showing a breaker 90 according to a first embodiment, and FIG. 3 (*b*) is a diagram showing a breaker 90 according to a modification 1.
Figure 3B:
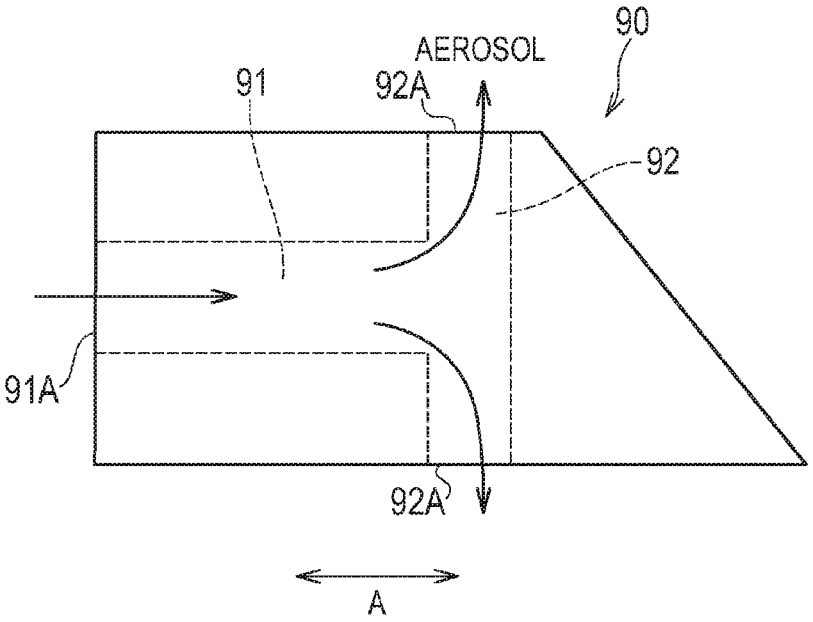

Specifically, as shown in FIG. 3 (*a*) in the first embodiment, the breaker 90 is the hollow needle of cylindrical shape having a hollow 91 extending along the predetermined direction A. Here, the hollow 91 penetrates the breaker 90. Thereby, the hollow 91 forms the airflow path that communicates pneumatically the atomizing unit 120 with the capsule unit 130. That is, the aerosol is guided into the capsule unit 130 while passing through the hollow 91.

In contrast, as shown in FIG. 3 (*b*) in the modification 1, the breaker 90 has a hollow 91 extending along the predetermined direction A and hollow 92 extending along a direction crossing the predetermined direction A. Note that, an opening 92A of the hollow 92 located in the capsule unit 130 when the capsule unit 130 is attached. Thereby, the hollow 91 and hollow 92 form the airflow path that communicates pneumatically the atomizing unit 120 with the capsule unit 130. That is, the aerosol is guided into the capsule unit 130 while passing through the hollow 91 and the hollow 92.

As shown in FIG. 3 (*b*) in the modification 1, the opening 92 A of the hollow 92 exposed in the capsule unit 130 is provided on a peripheral of the breaker 90 rather than a tip of the breaker 90. That is, the opening 92 A of the hollow 92 is provided on the peripheral of the breaker 90 while an opening 91 A of the hollow 91 is provided at the tip of the breaker 90. Therefore, the flavor source 131 filled in the capsule unit 130 hardly enters the airflow path (the hollow 91) when a part of the predetermined film 133 of the capsule unit 130 is broke by the breaker 90, and it is possible to suppress a clopping of the airflow path.

In the example shown in FIG. 3 (*b*), the hollow 91 does not penetrate the breaker 90. However, the embodiment is not limited to this. The hollow 91 may penetrate the breaker 90 along the predetermined direction A.

As described above, the meshes having the roughness of not passing the material composing the flavor source 131 is provided inside the breaker 90. In the example shown in FIG. 3 (*a*), the meshes are provided in the hollow 91. In the example shown in FIG. 3 (*b*), the meshes may be provided in the hollow 91 but also be provided in the hollow 92. The meshes are preferably provided in both of the hollow 91 and hollow 92. In such a case, the meshes provided in the hollow 91 is preferably provided at the opening 91 A of the hollow 91, and the meshes provided in the hollow 92 is preferably provided at the opening 92 A of the hollow 92.

Even when the material composing the flavor source 131 is entered the hollow 92 and the hollow 91 from the meshes provided in the hollow 92, the material does not fall off toward the absorber 70 and the heat source 80, by providing the meshes in both of the hollow 91 and hollow 92. Thereby, thermal decomposition of the material, caused by the contact of the material composing the flavor source 131 and the heat source 80, can be suppressed. Moreover, solution of impurities within the material into a liquid, caused by the contact of the material composing the flavor source 131 and the aerosol source absorbed by the absorber 70, can be suppressed.

OTHER EMBODIMENTS

The present invention has been explained according to the embodiment described hereinbefore. However, the description and drawings constituting a part of the disclosure are not to be understood to limit the invention. Various alternative embodiments, examples, and operational techniques will be apparent to those skilled in the art from this disclosure.

In the embodiment, although not specifically mentioned, the non-burning type flavor inhaler 100 has a columnar shape such as polygons and cylindrical shapes. For example, in the predetermined direction A, the length of the electrical unit 110 is 70 mm, and the length of the atomizing unit 120 is 55 mm.

In the embodiments, the flavor source 131 is provided on the inhalation end side that the holder 60 holding the aerosol source. From the viewpoint of airflow path, this means that the flavor source 131 is located on the inhalation side than the aerosol source. Therefore, the phrase "inhalation end side" is not to be considered as a portion depending on the physical location of the mouth end in a state that the capsule unit 130 is not attached to the non-burning type flavor inhaler 100, but a portion to be determined from the viewpoint of the airflow path in a state that the capsule unit 130 is attached to the non-burning type flavor inhaler 100 and that the non-burning type flavor inhaler 100 is usable.

In the embodiments, the electrical unit 110 has a female connector, and the atomizing unit 120 has a male connector. However, the embodiments are not to be limited to this. The electrical unit 110 may have a male connector, and the atomizing unit 120 may have a female connector.

Although the heat source 80 is exampled as the atomizer atomizing the aerosol source without burning in the embodiment, the embodiment is not limited to this. The atomizer atomizing the aerosol source without burning may be a unit atomizing the aerosol source by ultrasonic.

It is noted that the entire content of Japan Patent Application No. 2013-204177 (filed on Sep. 30, 2013) is incorporated in the present application by reference.

INDUSTRIAL APPLICABILITY

According to the present invention, it is possible to provide a non-burning type flavor inhaler and a capsule unit that can suppress a waste of the article composing the inhaler while suppressing degradation of a flavor source.

The invention claimed is:

1. A non-burning type flavor inhaler comprising:
- a first portion including a power source;
- a second portion including a heat source and an aerosol source;
- a third portion including a flavor source; and
- an aerosol path providing a path of an aerosol from the heat source to the flavor source;

wherein:
- the second portion is provided on a mouth piece side of the first portion,
- the third portion is provided on a mouth piece side of the second portion,
- the aerosol path includes a first aerosol path provided on a side of the heat source and a second aerosol path provided on a side of the flavor source,
- a partition member for partitioning the second portion and the third portion is provided between the second portion and the third portion, and
- the partition member includes a through hole that forms a part of the second aerosol path.

2. The non-burning type flavor inhaler according to claim 1, wherein:
- the aerosol path extends in a predetermined direction from the first portion to the third portion, and
- a cross-sectional area of the second aerosol path perpendicular to the predetermined direction is smaller than a cross-sectional area of at least a part of the first aerosol path perpendicular to the predetermined direction.

3. The non-burning type flavor inhaler according to claim 2, wherein the part of the first aerosol path is a part where adjacent to the partition member.

4. The non-burning type flavor inhaler according to claim 1, comprising:
- a member provided on a mouth piece side of the third portion,
- wherein the member includes openings each having a size for not passing through a material forming the flavor source.

5. The non-burning type flavor inhaler according to claim 1, wherein the second portion is configured to be attachable/detachable to/from the first portion.

6. The non-burning type flavor inhaler according to claim 1, wherein the third portion is configured to be attachable/detachable to/from the second portion.

7. The non-burning type flavor inhaler according to claim 1, comprising:

a fourth portion having a mouth piece opening to provide the aerosol to a user, as a portion different from the third portion.

8. The non-burning type flavor inhaler according to claim 7, wherein:

the aerosol path extends in a predetermined direction from the first portion to the fourth portion, and a cross-sectional area of the mouth piece opening perpendicular to the predetermined direction is smaller than a cross-sectional area of the third portion at a downstream end of the aerosol path which is perpendicular to the predetermined direction.

9. The non-burning type flavor inhaler according to claim 1, wherein the aerosol path is formed by an attachment of the third portion to the second portion.

10. The non-burning type flavor inhaler according to claim 1, wherein:

the aerosol path extends in a predetermined direction from the first portion to the third portion, and the third portion includes portions having different cross-sectional areas perpendicular to the predetermined direction.

11. The non-burning type flavor inhaler according to claim 1, wherein the aerosol source is a liquid and the flavor sour is solid.

12. The non-burning type flavor inhaler according to claim 1, wherein the aerosol source is formed of a liquid not containing a nicotine component.

13. The non-burning type flavor inhaler according to claim 1, wherein:

an inner space of the third portion accommodates the flavor source and forms a path of aerosol generated from the heat source, the third portion includes an upstream portion positioned at an upstream side of the path of aerosol and a downstream portion positioned at a downstream side of the path of aerosol, and a cross-sectional area of the downstream portion is larger than a cross-sectional area of the upstream portion.

14. The non-burning type flavor inhaler according to claim 4, wherein the member is a filter.

15. The non-burning type flavor inhaler according to claim 1, wherein the third portion has a mouth piece opening to provide the aerosol to a user.

16. The non-burning type flavor inhaler according to claim 1, wherein the partition member is provided at the second portion.

* * * * *